US005190640A

United States Patent [19]

Roof et al.

[11] Patent Number: 5,190,640

[45] Date of Patent: Mar. 2, 1993

[54] TREATMENT OF OILS USING AMINOCARBINOLS

[75] Inventors: Glenn L. Roof, Sugar Land; Lawrence N. Kremer; Robert V. Market, Friendswood, all of Tex.

[73] Assignee: Baker Hughes Incorporated, Houston, Tex.

[21] Appl. No.: 761,467

[22] Filed: Sep. 18, 1991

[51] Int. Cl.[5] ..... C10G 29/20

[52] U.S. Cl. ..... 208/236; 208/189; 208/207; 208/208 R

[58] Field of Search ..... 208/189, 207, 208 R, 208/236, 237

[56] References Cited

U.S. PATENT DOCUMENTS

| | | | |
|---|---|---|---|
| 2,589,450 | 3/1952 | Stanton | 208/204 |
| 3,516,793 | 6/1970 | Renault | 423/573.1 |
| 3,600,328 | 8/1971 | Lieffers | 366/135 |
| 3,601,015 | 8/1972 | Gelbein et al. | 423/228 |
| 3,685,960 | 8/1972 | Benson | 423/229 |
| 4,079,117 | 3/1978 | Butwell | 423/228 |
| 4,089,192 | 4/1978 | Van Scoy | 423/226 |
| 4,096,085 | 6/1978 | Holoman et al. | 252/189 |
| 4,205,050 | 5/1980 | Piehl et al. | 423/228 |
| 4,405,585 | 9/1983 | Sartori et al. | 423/228 |
| 4,406,868 | 9/1983 | Carter et al. | 423/228 |
| 4,421,725 | 12/1983 | Dezael et al. | 423/228 |
| 4,430,196 | 1/1984 | Niu | 208/47 |
| 4,490,275 | 12/1984 | Niu | 252/189 |
| 4,551,158 | 11/1985 | Wagner et al. | 55/46 |
| 4,557,991 | 12/1985 | Takagiwa et al. | 430/109 |
| 4,575,455 | 3/1986 | Miller | 423/228 |
| 4,594,147 | 6/1986 | Roof | 208/207 |
| 4,764,354 | 8/1988 | Kubek et al. | 423/228 |
| 4,867,865 | 9/1989 | Roof | 208/236 |
| 4,883,601 | 11/1989 | Koepke et al. | 210/710 |
| 4,957,715 | 9/1990 | Grover et al. | 423/228 |
| 4,978,512 | 12/1990 | Dillon | 423/226 |
| 4,997,630 | 3/1991 | Wagner et al. | 423/228 |
| 5,030,762 | 7/1991 | Drake | 564/508 |
| 5,074,991 | 12/1991 | Weers | 208/236 |

*Primary Examiner*—Theodore Morris
*Assistant Examiner*—Walter D. Griffin
*Attorney, Agent, or Firm*—Rosenblatt and Associates

[57] ABSTRACT

Sour sulfhydryl group containing oils and gases are treated with an effective amount of a sweetening, hydrogen sulfide quantity reducing aminocarbinol of the formula $$R_2N—CH(—R^1)OH$$

wherein $R^1$ is hydrogen or a hydrocarbyl or inertly substituted hydrocarbyl and each R is independently hydrocarbyl or inertly substituted hydrocarbyl or both R groups are collectively a divalent hydrocarbon or ether radical combined with the nitrogen of the aminocarbinol to form a heterocyclic ring represented by the formula $$(—R—R—)>N—CH(—R^1)OH.$$

The aminocarbinols used in this treatment are especially suitable for sour gases and high boiling, heavy residual fuels under low mix conditions.

19 Claims, No Drawings

TREATMENT OF OILS USING AMINOCARBINOLS

BACKGROUND OF THE INVENTION

This invention relates to the treatment of "sour" petroleum and coal liquefaction hydrocarbons containing hydrogen sulfide and other organosulfur compounds such as thiols and thiocarboxylic acids, and more particularly, to improved methods of treating such streams by using aminocarbinols.

Petroleum and synthetic coal liquefaction crude oils are converted into finished products in a fuel products refinery, where principally the products are motor gasoline, distillate fuels (diesel and heating oils), and bunker (residual) fuel oil. Vacuum distillation towers separate the crude into narrow boiling fractions. The vacuum tower cuts deeply into the crude while avoiding temperatures above about 800° F. which cause thermal cracking. A catalytic cracking unit cracks high boiling vacuum gas oil into a mixture from light gases to very heavy tars and coke. In general, very heavy virgin residuum (average boiling points greater than 1100° F.) is blended into residual fuel oil or thermally cracked into lighter products in a visbreaker or coker.

Overhead or distillate products in the refining process generally contain very little, if any, hydrogen sulfide ($H_2S$), but may contain sulfur components found in the crude oil, including mercaptans and organosulfides. However, substantial amounts of hydrogen sulfide, as well as mercaptans and organosulfides, are found in the vacuum distillation tower bottoms, which may be blended into gas oils and fuel oils. In addition, hydrogen sulfide is produced during catalytic cracking or coking of higher boiling fractions and vent streams from those operations and from other refining operations must be treated to remove the hydrogen sulfide.

As employed in this application, "hydrocarbons" is meant to include the unrefined and refined hydrocarbonaceous products derived from petroleum or from gasification or liquefaction of coal, both of which contain sulfur compounds. Thus, the term "hydrocarbons" includes, particularly for petroleum based fuels, sour natural gas, casinghead gas, wellhead condensate, and crude oil which may be contained in storage facilities at the producing field and transported from those facilities by barges, pipelines, tankers, or trucks to refinery storage tanks, or, alternatively, may be transported directly from the producing facilities through pipelines to the refinery storage tanks. The term "hydrocarbons" also includes refined products, interim and final, produced in a refinery, including distillates such as gasolines, distillate fuels, oils, and residual fuels.

Hydrogen sulfide in natural gas or in refinery gases or which collects in vapor spaces above confined hydrogen sulfide containing hydrocarbons (for example, in storage tanks or barges) is poisonous, in sufficient quantities, to workers exposed to the hydrogen sulfide. Mercaptans are strongly malodorous. Refined fuels must be brought within sulfide and mercaptan specifications for marketability. In the processing of hydrocarbons, it is desirable to eliminate or reduce atmospheric emissions of noxious hydrogen sulfide, mercaptan or other sulfhydryl compounds associated with sulfur containing hydrocarbons, in order to improve environmental air quality at refineries.

Numerous proposals have been made to sweeten sour distillate products and to scrub hydrogen sulfide from sour gases by treatment with a variety of amine derivatives or other additives. Disclosures illustrative of these are contained in U.S. Pat. Nos. 4,997,630 (methyldiethanolamine); U.S. Pat. No. 4,978,512 (reaction product of monoethanolamine and formaldehyde); U.S. Pat. Nos. 4,957,715; 4,883,601; 4,764,354; 4,575,455; 4,557,991 (alkanolamines generally); U.S. Pat. No. 4,551,158 (methyldiethanolamine); U.S. Pat. No. 4,421,725(tertiary alkanolamine); and other processes involving the use of alkanolamines: U.S. Pat. Nos. 4,406,868; 4,205,050; 4,096,085; 4,085,192; 4,079,117; 3,685,960; 3,681,015; 3,516,793; 2,600,328; and 2,589,450. In gas scrubbing where alkaline aqueous scrubbing solutions normally are employed, alkanolamines are employed because of their solubility in water and alkalinity. In U.S. Pat. No. 4,405,585, a sterically hindered secondary aminoether alcohol was employed to selectively scrub hydrogen sulfide gas from a gaseous mixture of hydrogen sulfide and $CO_2$. Dimethylaminoethanol and dimethylisopropanolamine were employed in U.S. Pat. Nos. 4,490,275 and 4,430,196 to neutralize acidic components in petroleum refining units. U.S. Pat. No. 5,030,762 suggests a quaternized adduct of formaldehyde and a secondary amine is useful for absorption of sulfur compounds produced by combustion of hydrocarbon materials.

The prior art relating to the treatment of sour petroleum oils also includes methods in which choline base has been employed to treat sour heavy fuel oils to maintain the hydrogen sulfide content in the atmosphere above or associated with such oils at levels within acceptable limits to avoid health hazards to personnel, as disclosed in U.S. Pat. No. 4,867,865. Choline base also has been used to treat gasoline and other motor fuels to remove organosulfur compounds such as thiols, thiolcarboxylic acids, disulfides and polysulfides, as disclosed in U.S. Pat. No. 4,594,147.

The use of choline base for these purposes has its drawbacks. Choline base itself has a strong unpleasant odor, and at low mix conditions has limited oil solubility. In the presence of water, choline base, like the alkanolamines described above, tends to seek the water in preference to oil, and does not distribute easily and thoroughly in oil without high mixing conditions. For example, it is recommended added by injection into the suction side of the product pump. Especially, this is a problem with fuel oils and residual oils. These heavy, high boiling fuels do not normally flow well at ambient temperatures, and heating at temperatures above about 140° F. and high mix conditions are necessary to mix choline base into them. High mix conditions do not always exist, or may not be feasible, and a better way to treat hydrocarbons remains a challenge in order to reduce hazards of hydrogen sulfide exposure to workers, to bring fuels within sulfide or mercaptan specifications, and to eliminate or reduce atmospheric emissions of noxious hydrogen sulfide, mercaptan or other sulfhydryl compound odors associated with such fuels for improved environmental air quality.

SUMMARY OF THE INVENTION

In accordance with this invention, a new method is provided for sweetening hydrocarbons which contain at least hydrogen sulfide ($H_2S$) and may also contain organosulfur compounds having a sulfhydryl (—SH) group, also known as a mercaptan group, such as, thiols (R—SH, where R is hydrocarbon group), thiol carboxylic acids (RCO—SH), and dithio acids (RCS—SH). Such oils are treated with an effective sweetening and hydrogen sulfide vapor quantity reducing amount of an aminocarbinol of the formula $$R_2N—CH(—R^1)OH$$

wherein $R^1$ is hydrogen or a hydrocarbyl or inertly substituted hydrocarbyl and each R is independently hydrocarbyl or inertly substituted hydrocarbyl or both R groups are collectively a divalent hydrocarbon or ether radical combined with the nitrogen of the aminocarbinol to form a heterocyclic ring represented by the formula $$(—R—R—)>N—CH(—R^1)OH.$$

The aminocarbinols used in this treatment are suitable for treating all hydrocarbons, but especially are useful for treating sour gases and high boiling, heavy residual fuels under low mix conditions. Preferred treatment temperatures are from ambient to about 400° F.

Such aminocarbinols may also be used to reduce hydrogen sulfide vapor in vapor spaces above confined oils to acceptable limits by treating such oils with an effective hydrogen sulfide quantity reducing amount of such aminocarbinols. Such treatment is effective where the hydrogen sulfide level above the liquid petroleum hydrocarbon to be treated is between 10 ppm to 100,000 ppm.

Such aminocarbinols may also be used to reduce noxious atmospheric odors of hydrogen sulfide, mercaptans and other sulfhydryl compounds from oils by treating such products with an effective odor reducing amount of such aminocarbinols.

DESCRIPTION OF THE PREFERRED EMBODIMENT

In accordance with this invention, the aminocarbinol may have the formula $R_2N—CH_2OH$. Aminocarbinols of this formula suitably include ones in which R is an alkyl, cycloalkyl, aryl, arylalkyl or alkaryl group; for example, where R is an alkyl group, aminocarbinols include dimethylaminocarbinol, methylethylaminocarbinol, methylpropylaminocarbinol, diethylaminocarbinol, ethylpropylaminocarbinol, ethylbutylaminocarbinol, di-isopropylaminocarbinol, dibutylaminocarbinol, dipentylaminocarbinol, dihexylaminocarbinol, dioctylaminocarbinol and dicocoaminocarbinol. Where R is a cycloalkyl group, the aminocarbinols include dicyclopentylaminocarbinol and dicyclohexylaminocarbinol. Where R is an aryl group, the aminocarbinols include diphenylaminocarbinol, methylphenylaminocarbinol and ethylphenylaminocarbinol. Where R is an alkarylgroup, the aminocarbinols include dibenzylaminocarbinol, methylbenzylaminocarbinol and di-(p-methylphenyl)-aminocarbinol.

Aminocarbinols of the formula $(—R—R—)>N—CH_2OH$ suitably include pyrrolidinocarbinol, piperidinocarbinol and morpholinocarbinol.

In the above examples, $R^1$ of the formula $$R_2N—CH(—R^1)OH$$

is hydrogen. R may also be an alkyl, cycloalkyl, aryl, arylalkyl or alkaryl group. Suitably, an alkyl group is a $C_1$-$C_5$ group, an cycloalkyl is a cyclopentyl or cyclohexyl group, an aryl is a phenyl group, an arylalkyl is a benzyl group and an alkaryl group is an alkyl substituted phenyl group; an example in which $R^1$ is phenyl and both R groups are collectively a divalent ether radical combined with the nitrogen of the aminocarbinol is 1-morpholino, 1-phenylmethanol.

The aminocarbinols of this invention are suitably produced by contacting an aldehyde with a secondary amine, preferably at a high enough temperature to cause the amine and aldehyde to react in a short time. Higher temperatures require use of higher pressure equipment to retain higher vapor pressures where one or both of the amine or aldehyde is in the vapor phase. Preferably, the temperature of reaction is from about ambient temperature to about 80° C., more preferably, from about 20° C. to about 50° C. The secondary amine can be added as a gas or liquid, according to the particular amine. When added as a gas, it preferably is bubbled into a solution of the aldehyde. Preferably, a slight excess of aldehyde to amine is employed, i.e., from about 2:1 down to about 1:1, the more preferred ratio being from about 1.3:1 to about 1:1. A slight excess of amine is desired to minimize the concentration of unreacted aldehyde in the final product. Unreacted amine and aldehyde do not interfere with the hydrogen sulfide abatement reactions involved in this invention, and, accordingly, the purity of the product is not critical. However, an adduct of the secondary amine and aldehyde greater than 50% is desirable for economic reasons.

To sweeten a hydrocarbon, the molar amount of aminocarbinols of this invention added to the sour hydrocarbon is directly proportional to the molar amounts of hydrogen sulfide, mercaptans or other organosulfur compound(s) having a sulfhydrylgroup which are present in the hydrocarbon. For oils, aminocarbinol suitably is mixed in the oil at temperatures at which the oil is flowable for ease of mixing until reaction with hydrogen sulfide or with sulfhydryl-containing organosulfur compounds has produced a product with sulfhydryls removed to an acceptable or specification grade oil product. To reduce hydrogen sulfide in the vapor space above confined oils to within acceptable limits, preferably an amount of the aminocarbinol of this invention directly proportional to the amount of hydrogen sulfide present in the vapor space is employed to treat the oil.

To reduce noxious atmospheric odors of hydrogen sulfide, mercaptans and other organosulfhydryl compounds from oils, effective odor reducing amounts of the aminocarbinol are used to treat the oil. Such amounts are in direct proportion to the concentration of sulfhydryl groups. Without being bound to a particular explanation for the mechanism by which the aminocarbinol of this invention react with the sulfhydryl groups, it is believed that the reaction generally may be described as follows:

$$R_2N—CH(—R^1)OH+H_2S \rightarrow R_2N—CH(—R^1)SH+H_2O \quad (1)$$

$$R_2N—CH(—R^1)SH+R_2N—CH(—R^1)OH \rightarrow (R_2N—CH(—R^1)—)_2S+H_2O \quad (2)$$

or $$(—R—R—)>N—CH(—R^1)OH+H_2S \rightarrow (—R—R—)>N—CH(—R^1)SH+H_2O \quad (1)$$

$$(—R—R—)>N—CH(—R^1)SH+(—R—R—)>N—CH(—R^1)OH \rightarrow (—R—R—)>N—CH(—R^1)—S—CH(—R^1)—N<(—R—R—)+H_2O \quad (2)$$

The reaction proceeds more quickly at elevated temperatures and the oil may have a temperature of up to about 400° F. without significant loss of activity of the tertiary aminocarbinol treating agent. Hydrogen sulfide contents of up to about 100,000 ppm in oil may be treated satisfactorily in accordance with this method.

The following examples illustrate the use of four aminocarbinols employed to treat crude stocks spiked with hydrogen sulfide.

EXAMPLE I

Hydrogen sulfide laden vacuum tower bottoms fuel from a West Coast (U.S.) refinery was added to a container containing dibutylaminocarbinol in a predosed quantity. The container was closed, and the closed container was heated for two hours at 180° F. The vapor space in the container was then analyzed using a Drager tube, with the following results versus a blank of the same fuel heated identically.

TABLE 1

| ADDITIVE | DOSE (ppm-w) | $H_2S$ LEVEL (ppm-v) |
|---|---|---|
| Blank | — | 1,200 |
| Dibutylamino carbinol | 250 | 620 |

This data shows dibutylaminocarbinol is effective to reduce $H_2S$ content in the head space of a container holding an $H_2S$ laden fuel.

EXAMPLE II

Vacuum tower bottoms fuel from a Gulf Coast (U.S.) refinery was collected in a dibutylaminocarbinol predosed Welker $H_2S$ testing and mixing unit. Another sample of the same fuel was collected in a Welker unit predosed with aqueous choline base (40% choline base). The dosed samples and an undosed blank sample of the same fuel were heated at 180° F. for two hours and the vapor space of each was then analyzed with Drager tubes, with the following results:

TABLE 2

| ADDITIVE | DOSE (ppm-w) | $H_2S$ LEVEL (ppm-v) |
|---|---|---|
| Blank | — | 500 |
| 40% Choline base | 50 | 150 |
| 40% Choline base | 100 | 75 |
| Dibutylamino carbinol | 100 | 150 |
| Dibutylamino carbinol | 150 | <50 |

This data also shows dibutylamino carbinol is effective to reduce $H_2S$ content in the head space of a container holding an $H_2S$ laden fuel.

EXAMPLE III

A solution containing dibutylaminocarbinol was used in a bubble cap plate tower test module to scrub a sour gas. The test gas composition comprised 2,000 ppm $H_2S$, 1% $CO_2$ and the balance, methane. The bubble tower had a 1.25" inner diameter and a gas dispersion disc dimension of 35 microns. Gas flow rate in the tower was 5.5 standard cubic feet per hour (scfh) at a test pressure of 20 psig and test temperature of 75° F. The scrubbing solution was 100 gm of a 10% solution of dibutylaminocarbinol. The solution was placed in the bubble tower, the test gas was flowed through the bubble tower at 5.5 scfh, and $H_2S$ in the outlet gas from the bubble tower was measured using Drager tubes. The data collected follows:

TABLE 3

| Time Minutes | Outlet Gas $H_2S$ (ppm) |
|---|---|
| 0 | 0 |
| 5 | 0 |
| 10 | 3 |
| 15 | 3 |
| 20 | 5 |
| 25 | 10 |
| 30 | 20 |

From the data in Table 3, an aminocarbinol in accordance with the present invention is seen useful to scrub sour gas.

EXAMPLE IV

Gulf Coast Visbreaker resid in nitrogen sparged septum bottles was used to evaluate the test aminocarbinol compound produced according to this example. All measurements were made at 140° F. The hydrogen sulfide was determined by gas chromotography with a flame photometric detector which is specific for sulfur containing molecules.

An aminocarbinol was synthesized by reacting 55.01 g benzaldehyde with 45.11 g morpholine over a five minute period. The reaction mixture exothermed to 71° C. The product was confirmed by NMR to be 1-morpholino, 1-phenylmethanol. A dose response curve was generated by sequentially adding larger doses of the product compound to 69.43 g of test fuel oil in a septum bottle. The $H_2S$ in the headspace of the bottle was withdrawn by syringe and injected into a gas chromatograph for analysis. The following levels of $H_2S$ were recorded.

| Total Amount of Compound Added (μL) | $H_2S$ (ppm-V) |
|---|---|
| 0 | 3212 |
| 5 | 3646 |
| 25 | 2856 |
| 45 | 2345 |
| 85 | 1592 |

The samples were thermostatted at 60° C. for 60 hours to determine if further reaction with the $H_2S$ would occur. The level of $H_2S$ had dropped to 47 ppm during this period indicating that further reaction was occurring. An additional 10 microliters of the compound was injected into the fuel which further reduced the $H_2S$ to 23 ppm.

Having now described our invention, variations, modifications and changes within the scope of our invention will be apparent to those of ordinary skill in the art, as set forth in the following claims.

What is claimed is:

1. A method of sweetening sour hydrocarbons, which comprises treating said hydrocarbons with an effective sweetening amount of a compound of an aminocarbinol of the formula $$R_2N—CH(—R^1)OH$$

wherein $R^1$ is hydrogen or a hydrocarbyl or inertly substituted hydrocarbyl and each R is independently hydrocarbyl or inertly substituted hydrocarbyl or both R groups are collectively a divalent hydrocarbon or ether radical combined with the nitrogen of the aminocarbinol to form a heterocyclic ring represented by the formula $$(-R-R-)>N-CH(-R^1)OH.$$

2. A method of reducing hydrogen sulfide vapor in a vapor space above a confined sour hydrocarbon which comprises treating said contined sour hydrocarbon with an effective hydrogen sulfide quantity reducing amount of an aminocarbinol of the formula $$R_2N-CH(-R^1)OH$$

wherein $R^1$ is hydrogen or a hydrocarbyl or inertly substituted hydrocarbyl and each R is independently hydrocarbyl or inertly substituted hydrocarbyl or both R groups are collectively a divalent hydrocarbon or ether radical combined with the nitrogen of the aminocarbinol to form a heterocyclic ring represented by the formula $$(-R-R-)>N-CH(-R^1)OH.$$

3. A method of reducing noxious odors of hydrogen sulfide, mercaptans and other sulfhydryl compounds in the atmosphere from a sour hydrocarbon which comprises treating said sour hydrocarbon with an effective odor hydrogen sulfide quantity reducing amount of a compound of an aminocarbinol of the formula $$R_2N-CH(-R^1)OH$$

wherein $R^1$ is hydrogen or a hydrocarbyl or inertly substituted hydrocarbyl and each R is independently hydrocarbyl or inertly substituted hydrocarbyl or both R groups are collectively a divalent hydrocarbon or ether radical combined with the nitrogen of the aminocarbinol to form a heterocyclic ring represented by the formula $$(-R-R-)>N-CH(-R^1)OH.$$

4. A method of sweetening sour residual fuel comprising treating said sour residual fuel with an effective sweetening amount of an aminocarbinol of the formula $$R_2N-CH(-R^1)OH$$

wherein $R^1$ is hydrogen or a hydrocarbyl or an inertly substituted hydrocarbyl and each R is independently a hydrocarbyl or an inertly substituted hydrocarbyl or both R groups collectively are a divalent hydrocarbon or ether radical combined with the nitrogen of the aminocarbinol to form a heterocyclic ring represented by the formula $$(-R-R-)>N-CH(-R^1)OH.$$

5. A method of sweetening sour gas comprising treating said sour gas with an effective sweetening amount of an aminocarbinol of the formula $$R_2N-CH(-R^1)OH$$

wherein $R^1$ is hydrogen or a hydrocarbyl or an inertly substituted hydrocarbyl and each R is independently a hydrocarbyl or an inertly substituted hydrocarbyl or both R groups collectively are a divalent hydrocarbon or ether radical combined with the nitrogen of the aminocarbinol to form a heterocyclic ring represented by the formula $$(-R-R-)>N-CH(-R^1)OH.$$

6. A method of sweetening sour hydrocarbons comprising treating said sour hydrocarbons at a temperature from about 100° F. to about 400° F. with an effective sweetening amount of an aminocarbinol of the formula $$R_2N-CH(-R^1)OH$$

wherein $R^1$ is hydrogen or a hydrocarbyl or an inertly substituted hydrocarbyl and each R is independently a hydrocarbyl or an inertly substituted hydrocarbyl or both R groups collectively are a divalent hydrocarbon or ether radical combined with the nitrogen of the aminocarbinol to form a heterocyclic ring represented by the formula $$(-R-R-)>N-CH(-R^1)OH.$$

7. A method of sweetening sour hydrocarbons comprising treating said sour hydrocarbons with an amount of an aminocarbinol which is directly proportional to the sulfhydryl content of said sour hydrocarbons, said aminocarbinol having the formula $$R_2N-CH(-R^1)OH$$

wherein $R^1$ is hydrogen or a hydrocarbyl or an inertly substituted hydrocarbyl and each R is independently a hydrocarbyl or an inertly substituted hydrocarbyl or both R groups collectively are a divalent hydrocarbon or ether radical combined with the nitrogen of the aminocarbinol to form a heterocyclic ring represented by the formula $$(-R-R-)>N-CH(-R^1)OH.$$

8. A method of reducing hydrogen sulfide vapor in a vapor space above a confined sour hydrocarbon comprising treating said sour hydrocarbon with an amount of an aminocarbinol which is directly proportional to the amount of said hydrogen sulfide vapor present in said vapor space, said aminocarbinol having the formula $$R_2N-CH(-R^1)OH$$

wherein $R^1$ is hydrogen or a hydrocarbyl or an inertly substituted hydrocarbyl and each R is independently a hydrocarbyl or an inertly substituted hydrocarbyl or both R groups are collectively a divalent hydrocarbon or ether radical combined with the nitrogen of the aminocarbinol to form a heterocyclic ring represented by the formula $$(-R-R-)>N-CH(-R^1)OH.$$

9. A method of reducing hydrogen sulfide vapor having a concentration between about 10 to 100,000 ppm in a vapor space above a confined sour hydrocarbon comprising treating said sour hydrocarbon with an amount of an aminocarbinol which is directly proportional to the amount of said hydrogen sulfide vapor, said aminocarbinol having the formula $$R_2N-CH(-R^1)OH$$

wherein $R^1$ is hydrogen or a hydrocarbyl or an inertly substituted hydrocarbyl and each R is independently a hydrocarbyl or an inertly substituted hydrocarbyl or both R groups are collectively a divalent hydrocarbon or ether radical combined with the nitrogen of the aminocarbinol to form a heterocyclic ring represented by the formula $$(-R-R-)>N-CH(-R^1)OH.$$

10. The method of claim 1 wherein $R^1$ is a disubstituted aryl group.

11. The method of claim 1 wherein $R^1$ is a phenyl group.

12. The method of claim 1 wherein R is an n-butyl group.

13. The method of claim 4 wherein R is an n-butyl group.

14. The method of claim 5 wherein R is an n-butyl group.

15. The method of claim 8 wherein R is an n-butyl group.

16. The method of claim 4 wherein $R^1$ is a phenyl group.

17. The method of claim 5 wherein $R^1$ is a phenyl group.

18. The method of claim 8 wherein $R^1$ is a phenyl group.

19. The method of claim 4, 5, 8, 11, 16, 17, or 18 wherein $R^2N$ is a morpholino group.

* * * * *